US006030424A

United States Patent [19]

Matsumoto

[11] Patent Number: 6,030,424

[45] Date of Patent: Feb. 29, 2000

[54] WATER-IN-OIL EMULSION FUEL OIL PRODUCTION SYSTEM

[76] Inventor: Setsuo Matsumoto, 198 Regal Oak Ct., Thousand Oaks, Calif. 91320

[21] Appl. No.: 09/066,628

[22] Filed: Apr. 24, 1998

Related U.S. Application Data

[63] Continuation-in-part of application No. 09/004,165, Jan. 2, 1998.

[51] Int. Cl.[7] ..... C10L 1/32

[52] U.S. Cl. ..... 44/301; 44/639; 516/20; 516/927

[58] Field of Search ..... 44/301, 639; 576/54, 576/20, 927

[56] References Cited

U.S. PATENT DOCUMENTS

| | | | |
|---|---|---|---|
| 4,804,495 | 2/1989 | Bouchez et al. | 252/312 |
| 4,824,439 | 4/1989 | Polanco et al. | 44/51 |
| 4,886,519 | 12/1989 | Hayes et al. | 44/51 |
| 5,526,839 | 6/1996 | Padron | 137/13 |
| 5,556,574 | 9/1996 | Rivas et al. | 252/311.5 |
| 5,622,920 | 4/1997 | Rivas et al. | 507/232 |
| 5,879,419 | 3/1999 | Moriyama et al. | 44/301 |

*Primary Examiner*—Ellen M. McAvoy
*Attorney, Agent, or Firm*—Muramatsu & Associates

[57] ABSTRACT

A system for producing a water-in-oil emulsion fuel oil of improved combustion efficiency. The production system includes an additive solution tank for producing an emulsifying additive solution by mixing NAOH and $CaCl_2$ and water and storing the additive solution therein, a water tank for producing mixed water by mixing the emulsifying additive solution from the additive solution tank with water in a weight ratio greater than 1:100, a mixing tank for mixing heavy oil and the mixed water from the water tank having the water and emulsifying additive solution so that the water substantially uniformly distributed and suspended in the dispersion medium of the heavy oil to produce the water-in-oil oil emulsion fuel, and a storage tank for storing the water-in-oil emulsion fuel therein to provides the emulsion fuel to a burning facility.

26 Claims, 3 Drawing Sheets

× 170

× 250

× 170

WATER-IN-OIL EMULSION FUEL OIL PRODUCTION SYSTEM

This is a continuation-in-part of U.S. patent application Ser. No. 09/004,165 filed Jan. 2, 1998 and entitled "WATER-IN-OIL EMULSION FUEL OIL", now pending.

FIELD OF THE INVENTION

This invention relates to a production system and method for producing an additive solution for emulsifying fuel oil with water, and emulsified fuel oil (water-in-oil emulsion fuel oil) using the same.

BACKGROUND OF THE INVENTION

In a final stage of oil refining process, heavy oil is produced which is generally divided into three different classes, i.e., heavy oil type A, heavy oil type B and heavy oil type C in accordance with their viscosity. Since heavy oil generates high calory (more than 10,000 Kcal/Kg) and is relatively inexpensive and easy to handle, it is estimated that the commercial consumption of heavy oil accounts for nearly 70%–80% of all oil products which are used in Japan for facilities in various industries including large scale heating facilities and large vessels.

When heavy oil, in particular high viscosity heavy oil such as heavy oil B and heavy oil C, is burnt, a large volume of pollutants, such as, sulphur oxide, nitrogen oxide, carbon monoxide, soot and dust is generated. If no effective anti-pollution countermeasure is taken, these pollutants can contaminate the environment and pose a serious threat to the ecological system. Accordingly, the Japanese government sets various standards regarding the maximum permissible discharge levels of toxic pollutants for facilities which burn heavy oil. The government imposes on the industries strict preventive measures to keep the discharge level below the standard level. As a result, the industries in which heavy oil is used as a fuel generally tend to make substantially large investments to equip heavy oil burning facilities with highly complex and expensive antipollution devices and facilities.

However, these antipollution devices and facilities tend to become more complex and expensive, particularly when lower grade oil, such as heavy oil C, is used. Major electric companies, for example, use heavy oil C because heavy oil C is relatively inexpensive as compared with heavy oil A and B, although heavy oil C generates more pollutants. In order to comply with the government antipollution standard and regulation, these electric companies have to make substantial investments in antipollution facilities or, alternatively, mix heavy oil C with heavy oil A or heavy oil B in order to reduce emission of pollutants, resulting in a substantial increase in cost. Furthermore, a perfect combustion of heavy oil B and heavy oil C is relatively difficult unless they are sprayed into substantially small particles.

It is appreciated that, when heavy oil is used for the operation of, for example a boiler, heavy oil is sprayed by a jet injector to form a jet stream of very fine particles in order to achieve a satisfactory combustion. However, the jet stream itself tends to disrupt the combustion of the particles of heavy oil. This will lower the thermal efficiency of the boiler. In order to improve the thermal efficiency, the air/oil ratio may be adjusted. However, such an adjustment of air/oil ratio tends to enlarge the size of oil particles, and results in imperfect combustion of heavy oil and thus higher emission of pollutants.

Waste oil may be burnt for treatment. In facilities where waste oil is generated as a result of routine operations, such as, waste machine oil at a garage or a factory, waste machine oil may be separated into a reusable part, a non-reusable part, water, etc. In accordance with the Japanese government antipollution regulations, the non-reusable oil must be completely burnt in an incinerator while controlling the emission of pollutants below the strict discharge levels set by the government.

Water may be separated by using a waste oil purification separator tank or by natural separation of water from oil during storage. While the separated water generally does not appear to contain any waste oil, the water has offensive smell because it is contaminated with the waste oil. Therefore, the separated water must be thoroughly filtered and purified to completely remove oil content therefrom before the water is discharged. If this separated water is discharged into a river or a lake without a proper filtration or a purification treatment, the river or the lake will be contaminated. To filter and purify the separated water, a water filtration and purification facility is required, in addition to the waste oil treatment facilities.

SUMMARY OF THE INVENTION

It is an object of the present invention to provide a production system for producing an additive for emulsifying a fuel oil with water, and emulsified fuel oil using the same which is capable of reducing the emission of pollutants in the combustion of heavy oil and waste oil.

It is another object of the present invention to provide a production system and method with a relatively simple structure and process as well as low cost for producing a fuel oil product with low emission of pollutants.

It is a further object of the present invention to provide a production system and method for producing a heavy oil product with a higher combustion efficiency and a lower emission of pollutants.

It is a further object of the present invention to provide a production system and method for producing a heavy oil product with a higher combustion efficiency to substantially reduce overall consumption of heavy oil in heating facilities and the like.

It is still a further object of the present invention to provide a production system and method for producing an emulsified oil (water-in-oil fuel oil) product in which disperse phases of water are substantially uniformly distributed in a dispersion medium of oil.

The above noted objects and advantages are achieved in accordance with the production system and method of the present invention which produces a water-in-oil emulsion fuel in which each of the fuel particles has a core made of water encapsulated by the dispersion medium of heavy oil.

The production system of the present invention for producing a water-in-oil emulsion fuel includes an additive solution tank for producing an emulsifying additive solution by mixing NAOH and $CaCl_2$ and water and storing the additive solution therein, a water tank for producing mixed water by mixing the emulsifying additive solution from the additive solution tank with water in a weight ration more than 1:100 and storing the mixed water therein, a mixing tank for mixing heavy oil and the mixed water from the water tank having the water and emulsifying additive solution so that the water substantially uniformly distributed and suspended in the dispersion medium of the heavy oil to produce the water-in-oil emulsion fuel, and a storage tank for storing the water-in-oil emulsion fuel therein to provides the emulsion fuel to a burning facility.

Consequently, it is recognized that the particles comprise cores of water encapsulated in heavy oil, i.e., water-in-oil capsularized emulsion particle fuel. When the particles burn, the capsule portion of oil first evaporates and burns while the heat of the burning capsule portion of oil heats up the core of water. Before the capsule portion completely evaporates, the water at the core explosively evaporates and ruptures the shell of oil which sprays the oil content into much smaller particles. As a result, a complete combustion is achieved.

Thus, the water-in-oil fuel of the present invention substantially improves the thermal efficiency of boiler and other burning facilities and reduces the generation of pollutants and maintenance expenses for maintaining the facilities. Because of the high thermal efficiency of the boiler and other burning facilities, substantial reduction of oil consumption can be achieved.

BRIEF DESCRIPTION OF THE INVENTION

Figure 4:
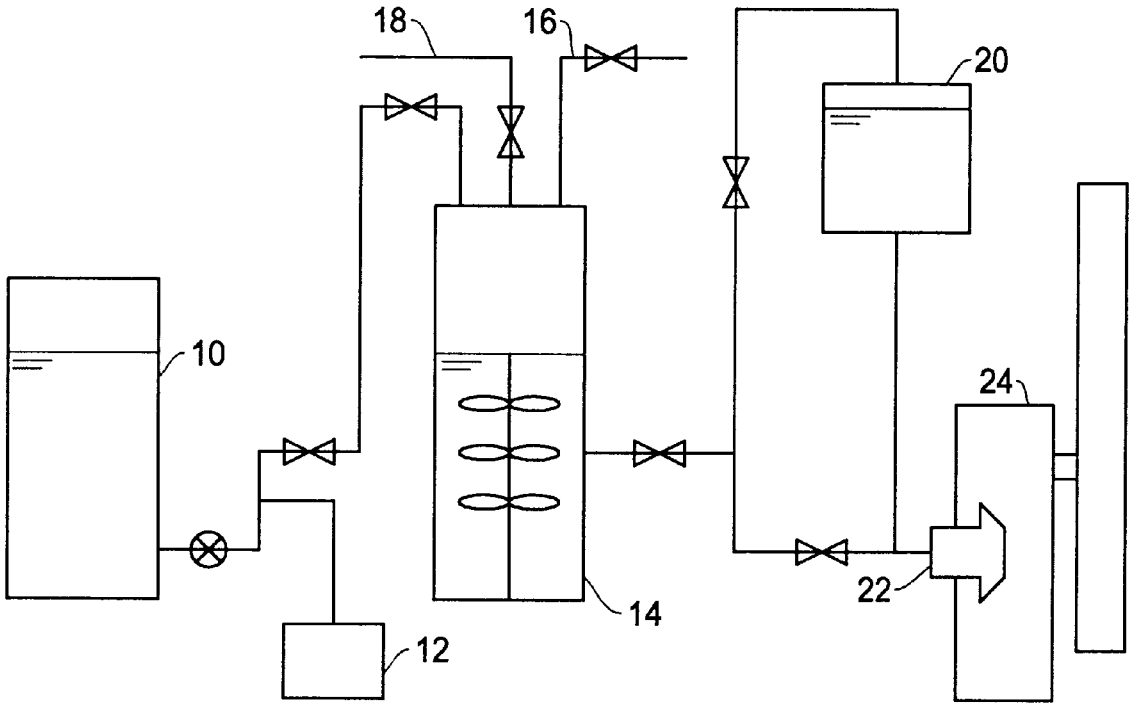

FIG. 4 schematically shows a layout of one embodiment of an emulsified fuel storage and supply system which supplies an emulsion fuel to a boiler facility.

Figure 5:
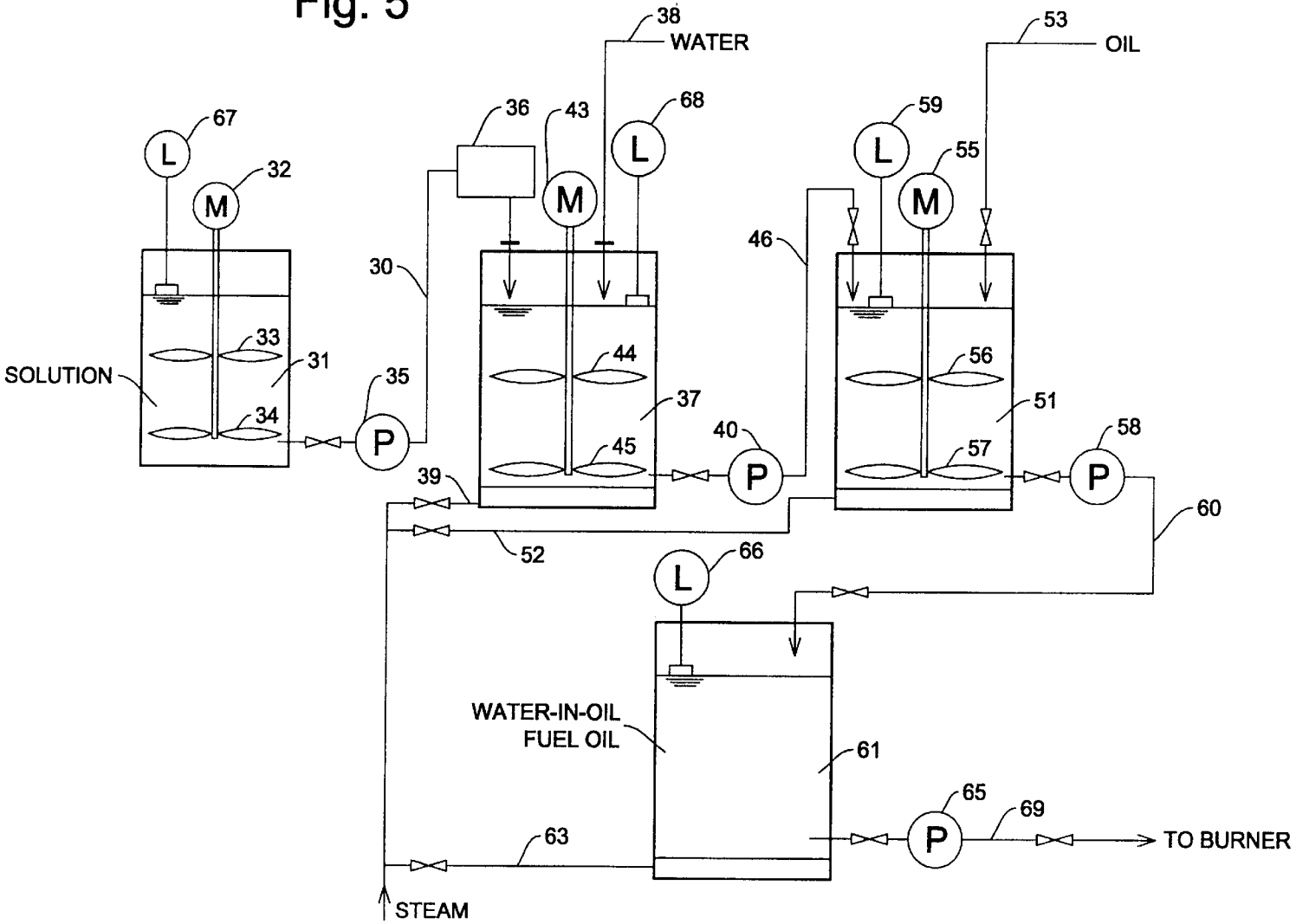

FIG. 5 is a schematic diagram showing an example of production system for producing a water-in-oil emulsion fuel in accordance with the present invention.

DETAILED DESCRIPTION OF THE PREFERRED EMBODIMENTS

In the embodiments of the present invention, an emulsifying additive solution is first produced to emulsify oil with water to form an water-in-oil emulsion. As described below in greater detail, the water-in-oil emulsion is essentially formed by disperse phases of water which are generally uniformly distributed and suspended in a dispersion medium of oil. In other words, particles of water are generally uniformly distributed and suspended in the body of oil in the water-in-oil emulsion.

In the water-in-oil emulsion, it is observed that each of the water particles is enclosed or encapsulated in oil, and that the water particles are separated from each other by oil. A variety of different types of oil have been examined. It has been recognized that an emulsifying additive in accordance with embodiments of the present invention effectively emulsifies, for example, a heavy oil (e.g. heavy oil A, B and C), motor oil which is used for lubrication of automobile engines, edible oil and other machine oil.

In accordance with one embodiment of the present invention, caustic soda (NaOH), calcium chloride ($CaCl_2$) and water are mixed together to form an emulsifying additive solution. It is noted that caustic soda (NAOH) and calcium chloride ($CaCl_2$) may be premixed prior to mixing with water, or all of the three may be mixed together at once. In one embodiment, substantially the same amount of caustic soda (NAOH) and calcium chloride ($CaCl_2$) are mixed with water.

A variety of mixing ratios between caustic soda (NAOH) and calcium chloride ($CaCl_2$) and water have been examined to verify the effectiveness of the emulsifying additive solution. Caustic soda (NAOH) and calcium chloride ($CaCl_2$) and water are mixed together in a weight ratio ranging between 10:10:100 and 50:50:100 (e.g., 10 Kg:10 Kg:100 Kg and 50 Kg:50 Kg:100 Kg) to form an emulsifying additive solution. These mixing ratios have been found to provide effective emulsifying additive solutions.

In preferred embodiments, caustic soda (NAOH) and calcium chloride ($CaCl_2$) and water are mixed together in a weight ratio ranging between 15:15:100 and 35:35:100 (e.g., 15 Kg:15 Kg:100 Kg and 35 Kg:35 Kg:100 Kg). It is recognized that these mixing ratios provide optimum emulsifying additive solutions in view of both the economy and efficiency. In a preferred embodiment, 20 Kg of caustic soda (NaOH), 20 Kg of calcium chloride (CaCl2) and 100 liter of water are thoroughly mixed at room temperature to form an emulsifying additive solution (Additive No. 1).

Further, a mixture of 30 Kg of caustic soda (NaOH), 30 Kg of calcium chloride ($CaCl_2$) and 100 liter of water, and a mixture of 25 Kg of caustic soda (NAOH) and 25 Kg of calcium chloride ($CaCl_2$) and 100 liter of water each provides substantially the same result in the emulsification of a heavy oil with water as obtained by the mixing ratio of 20 Kg of caustic soda (NAOH), 20 Kg of calcium chloride ($CaCl_2$) and 100 liter of water.

An emulsifying additive solution in accordance with an embodiment of the present invention is thoroughly mixed with oil and water to form a water-in-oil emulsion in which disperse phases of water are substantially uniformly distributed and suspended in a dispersion medium of oil. An emulsifying additive solution can be mixed with water and oil in a wide range of mixing ratios for effective emulsification of oil and water. According to tests carried out by the inventor, the emulsifying additive solution Additive No. 1 noted above efficiently emulsifies a mixture of oil and water having a mixing ratio ranging between about 95:5 and 30:70 (e.g., 95 Kg:5 Kg and 30 Kg:70 Kg).

In another test, heavy oil type C and water are mixed in a mixing ratio ranging between 70:30 and 75:25 (e.g., 70 Kg:30 Kg and 75 Kg:25 Kg) for an optimum combustion efficiency. In these tests, the emulsifying additive solution Additive No. 1 and mixture of water and oil were mixed in a mixing ratio ranging from about 0.002:1 to about 0.003:1 (e.g., 0.2 Kg of the emulsifying additive solution: 100 Kg of the mixture of water and oil and 0.3 Kg:100 Kg). These mixing ratios resulted in good emulsification of water and oil.

In a further embodiment, the emulsifying additive solution Additive No. 1 and the mixture of water and oil was mixed in a mixing ratio at 0.001:1 (e.g., 0.1 Kg:100 Kg). This mixing ratio generally resulted in good but minimum emulsification efficiency. In another embodiment, the emulsifying additive solution Additive No. 1 and the mixture of water and oil was mixed in a mixing ratio at 0.01:1 (e.g., 1 Kg:100 Kg).

The above noted mixing ratio of 0.01:1 shows a best efficiency in reaching an optimum level of emulsification. It is also observed that the efficiency in emulsification does not substantially change if the amount of the emulsifying additive solution is increased further than this mixing ratio with respect to the amount of the mixture of water and oil. Thus, preferred embodiments have a mixing ratio between the emulsifying additive solution Additive No. 1 and the mixture of water and oil at least 0.01:1.

Figure 1:
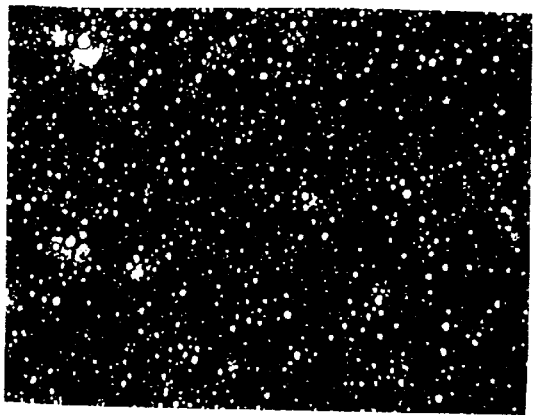
FIG. 1 is a microscopic photograph (170 times magnified) of a water-in-heavy oil emulsion which is obtained by the use of an emulsifying additive solution in accordance with one embodiment of the present invention.
Figure 2:
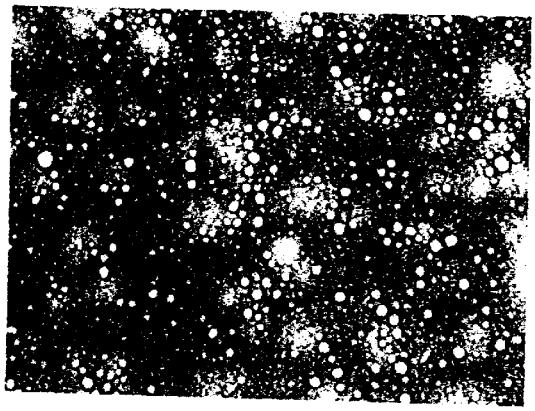
FIG. 2 is a microscopic photograph (250 times magnified) of a water-in-oil emulsion which is obtained by the use of an emulsifying additive solution in accordance with one embodiment of the present invention.

In one embodiment, heavy oil type C, water and Additive No. 1 in a weight ratio of 50:50:0.3 (e.g., 50 g:50 g:0.3 g)

were thoroughly and vigorously mixed until the mixture becomes an emulsion. The emulsion was stored at room temperature (about 25 degree Centigrade) for 7 days. Photographs of FIG. 1 and FIG. 2 were taken 7 days after the emulsion was made. As shown in the photographs of FIGS. 1 and 2, particles of water (white dots) are generally uniformly distributed and suspended in the heavy oil C (water-in-oil emulsion).

In a test to verify the magnitude of separation between .water content and oil content, a specimen (100 ml) of the emulsion was heated to 60 degree Centigrade and subjected to a centrifugal separator for 20 minutes at a relative centrifugal force of 600, it was observed that substantially no separation of water content from the oil content occurred. It was further observed that, even after 40 days, the emulsion was stable, and the water content and oil content did not separate from each other.

In another embodiment, heavy oil C, water and Additive No.1 in a weight ratio of 30:70:0.3 were thoroughly and vigorously mixed until the mixture becomes an emulsion. It was also observed that substantially no separation of water content from the oil content occurred. The emulsion at this mixing ratio has a volume resistivity of about $4.1\times10^{9}$. It is observed that the volume resistivity does not change for a long time. This also shows that the water-in-oil emulsion fuel made in accordance with embodiments of the present invention is very stable and therefore can be stored for a long time. As a result, the water-in-oil emulsion fuel made in accordance with embodiments of the present invention can be used immediately after storage of the emulsion fuel for a substantial period of time without an extra mixing operation for re-emulsification.

Figure 3:
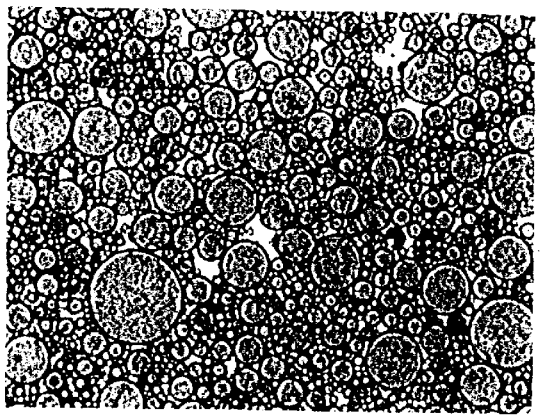
FIG. 3 is a microscopic photograph (170 times magnified) of an oil-in-water emulsion which is obtained by the use of a conventional emulsifying additive.

In contrast, when heavy oil type C, water and a conventional emulsifying agent (a surface active agent) in a weight ratio of 50:50:2.5 (e.g., 50 g:50 g:2.5 g) are mixed until the mixture becomes an emulsion, particles of heavy oil type C (circular dots in various sizes) are suspended in water (oil-in-water emulsion), as shown in a photograph of FIG. 3. It is observed that the oil-in-water emulsion made by typical conventional emulsifying agent is not stable. The oil content and the water content of the oil-in-water emulsion generally start separating from each other in several days after the oil-in-water emulsion is formed.

In the above embodiments, caustic soda (NAOH) and calcium chloride ($CaCl_2$) and water are first mixed to form an emulsifying additive solution, and the emulsifying additive solution is added to oil and water only when an emulsion of the oil and water is to be made. Caustic soda (NAOH) and calcium chloride ($CaCl_2$) may be directly added in water and oil when the water and oil are mixed. However, it is observed that if caustic soda (NAOH) and calcium chloride ($CaCl_2$) are directly added in water and oil when an emulsion is made, a substantially larger amount of both caustic soda (NAOH) and calcium chloride ($CaCl_2$) is required as compared with the amount of the emulsifying additive solution which is required to achieve a similar result of emulsification.

FIG. 4 schematically shows a layout of one embodiment of an emulsified fuel storage and supply system which supplies an emulsion fuel to a boiler facility. A storage tank 10 stores a fuel oil, such as for example, heavy oil B, C or a mixture thereof. The fuel oil stored in the storage tank 10 is pumped out by an oil pump 12 and conveyed to a mixer 14. At the mixer 14, the fuel oil is mixed with water supplied through a water supply line 16 and an emulsifying additive solution supplied through an emulsifying additive solution supply line 18.

The mixture of the fuel oil, water and emulsifying additive solution are thoroughly mixed until the mixture becomes an emulsion. The emulsion may be conveyed to an emulsion fuel storage tank 20 for storage or directly conveyed to a burner 22 for the operation of a boiler 24. Since the emulsion fuel made in accordance with embodiments of the present invention is stable, and the fuel oil content in the emulsion fuel does not separate from the water content, the emulsion fuel can be stored in the fuel storage tank 20 for a relatively long time.

FIG. 5 is a schematic diagram showing an example of production system for producing a water-in-oil emulsion fuel in accordance with the present invention.

A solution storage tank 31 stores an emulsifying additive solution made of, for example, caustic soda (NAOH) and calcium chloride ($CaCl_2$) and water with a weight ratio ranging, for example, between 15:15:100 and 35:35:100 (e.g., 15 Kg:15 Kg:100 Kg and 35 Kg:35 Kg:100 Kg). The solution storage tank 31 is provided with a motor 32 to rotate mixing blades 33 and 34 in the tank for occasionally mixing the additive solution. A level gauge 67 is provided to monitor the surface level of the additive solution in the solution tank 31. When the surface level is lower than the predetermined level, the level gauge 67 sends a signal to a control panel (not shown) so that new additive solution is produced in the solution tank 31.

The additive solution is supplied to a water tank 37 through a pump 35 and an adjustment tank 36 to be mixed with water. The adjustment tank 36 is to adjust the volume of additive solution to be supplied to the water tank. The water is supplied to the water tank 37 through a water supply pipe 38. The water tank 37 includes a motor 43 to rotate mixing blades 44 and 45 to effectively mix the additive solution with the water. The emulsifying additive solution and the water are mixed in a mixing ratio, for example, 0.003:1, i.e., 0.3 Kg of the emulsifying additive solution with respect to 100 Kg of the water.

A level gauge 68 is provided to monitor the surface level of the water mixed with the emulsifying additive solution in the water tank 37. When the surface level in the water tank 37 is lower than the predetermined level, the level gauge 68 sends a signal to the control panel to fill the water and the additive solution in the tank 37 to produce the mixture thereof. Preferably, the water tank 37 is provided with a steam pipe 39 to warm the water in the tank. Other means such as an electric heater may also be used to heat the water.

The warmed water mixed with the emulsifying additive solution is supplied to a mixing tank 51 through a pump 40 and pipe 46. A fuel oil, such as heavy oil B, heavy oil C or a mixture thereof is supplied from a storage (not shown) to the mixing tank 51 through an oil pipe 53. The mixing tank 51 includes a motor 55 connected to mixing blades 56 and 57 which rotate within the mixing tank, a level gauge 59 to monitor the liquid level in the mixing tank, and a steam pipe 52 for heating the liquid in the tank. The steam pipe 52 is useful to lower the viscosity of the liquid in the tank 51 particularly in a cold season.

At the mixing tank 51, the fuel oil is mixed with water which includes the emulsifying additive solution made in the water tank 37 and supplied through the water supply pipe 46. The mixing ratio of the heavy oil type C and water is ranging between 70:30 and 75:25 (e.g., 70 Kg:30 Kg and 75 Kg:25 Kg) for an optimum combustion efficiency. However, as noted above, a wide range of the mixing ratio between the heavy oil and the water is possible such as ranging from about 95:5 to about 30:70. The level gauge 59 monitors the surface level of the water-in-oil fuel in the mixing tank 51. When the surface level is lower than the predetermined level, the level gauge 59 sends a signal to the control panel (not shown) to fill the water with the additive solution and the heavy oil in the mixing tank 51 to produce additional water-in-oil fuel oil therein.

The water-in-oil fuel produced through the foregoing system and process is supplied to a fuel storage tank 61 through a pump 58 and a pipe 60. In the water-in-oil fuel of the present invention, particles of water are generally uniformly distributed and suspended in the heavy oil C. Since the water-in-oil fuel is stable and the water content and oil content will not separate from each other after several weeks, the storage tank 61 may store a large volume of fuel enough to be used for a relatively long time. Preferably, a steam pipe 63 is provided to heat the fuel in the storage tank 61 so as to prevent the fuel from increasing viscosity because of low temperature and the like.

The water-in-oil fuel stored in the storage tank 61 is introduced to a burner of a large scale heating facility (not shown) through a fuel pump 65 and a fuel pipe 69. A level gauge 66 may preferably be provided to monitor the surface level of the fuel oil in the storage tank 61 to introduce the new fuel oil from the mixing tank 51 when the surface level decreases to a specified level.

The water-in-oil emulsion fuel of the present invention is produced as described in the foregoing. Conventionally, a complete combustion of heavy oil type B and type C is relatively difficult unless they are sprayed into particles of substantially small diameter. Minute particles of heavy oil type C, for example, may completely evaporate and achieves a complete combustion. In contrast, when the size of particles of heavy oil type C is relatively large, the central portion of each particle does not completely evaporate even though the surface portion achieves a complete evaporation. Rather, the heat at the surface portion tends to solidify the central portion of the particle. This will cause a higher emission of pollutants.

An emulsifying additive solution in one aspect of the present invention provides a water-in-oil emulsion fuel in which disperse phases of water are distributed in a dispersion medium of oil. When the water-in-oil emulsion fuel is sprayed into minute particles, for example in the operation of a boiler, the particles have cores of water, in other words, cores of water are encapsulated in the heavy oil (encapsulated emulsion oil particles).

Therefore, when the particles burn, the capsule portion of oil first evaporates and burns while the heat of the burning capsule portion of oil heats up the core of water. Before the capsule portion completely evaporates, the water at the core explosively evaporates and ruptures the shell of oil which sprays the oil content into much smaller particles. As a result, a complete combustion is achieved. In general, in the operation of a boiler facility, the use of a water-in-oil emulsion fuel oil (water and heavy oil B or C) reduces air requirement for a complete combustion, improves the thermal efficiency of the boiler facility and reduces the generation and deposit of carbon and ash on the boiler interior walls. The water-in-oil emulsion fuel oil of the present invention also contributes to substantially reduce the oil consumption in such burning facilities because of the improvement in the thermal efficiency.

The presently disclosed embodiments are to be considered in all respects as illustrative and not restrictive. The scope of the invention being indicated by the appended claims, rather than the foregoing description, and all changes which come within the meaning and range of equivalency of the claims are, therefore, intended to be embraced therein.

What is claimed is:

1. A system for producing a water-in-oil emulsion fuel, comprising:

an additive solution tank for producing an emulsifying additive solution by mixing NAOH and $CaCl_2$ and water and storing the additive solution therein;

a mixing tank for mixing heavy oil, water and said emulsifying additive solution from said additive solution tank so that said water substantially uniformly distributed and suspended in the dispersion medium of said heavy oil to produce said water-in-oil emulsion fuel; and a storage tank for storing said water-in-oil emulsion fuel therein to provides said emulsion fuel to a burning facility.

2. A system for producing a water-in-oil emulsion fuel as defined in claim 1, wherein said NAOH; $CaCl_2$ and water are mixed in a weight ratio ranging from about 10:10:100 to about 50:50:100.

3. A system for producing a water-in-oil emulsion fuel as defined in claim 1, wherein said NAOH; $CaCl_2$ and water are mixed in a weight ratio ranging from about 15:15:100 to about 35:35:100.

4. A system for producing a water-in-oil emulsion fuel as defined in claim 1, wherein said NAOH; $CaCl_2$ and water are mixed in a weight ratio of about 20:20:100.

5. A system for producing a water-in-oil emulsion fuel as defined in claim 1, wherein said heavy oil includes heavy oil type A, heavy oil type B and heavy oil type C.

6. A system for producing a water-in-oil emulsion fuel as defined in claim 1, wherein said water and said heavy oil are mixed in said mixing tank in a weight ratio from about 95:5 to about 30:70.

7. A system for producing a water-in-oil emulsion fuel as defined in claim 1, wherein said water and said heavy oil are mixed in said mixing tank in a weight ratio from about 70:30 to about 75:25.

8. A system for producing a water-in-oil emulsion fuel as defined in claim 1, wherein said water-in-oil emulsion fuel oil in said storage tank has a mixing ratio between a sum of said water and heavy oil and said emulsifying additive solution from about 1:0.01 to about 1:0.001 in a weight ratio.

9. A system for producing a water-in-oil emulsion fuel as defined in claim 1, wherein said water-in-oil emulsion fuel oil in said storage tank has a mixing ratio between a sum of said water and heavy oil and said emulsifying additive solution from about 1:0.003 to about 1:0.002 in a weight ratio.

10. A system for producing a water-in-oil emulsion fuel as defined in claim 1, wherein said water substantially uniformly distributed and suspended in the dispersion medium of said heavy oil in such a manner that substantially each of the particles of said emulsion fuel has a core of said water encapsulated by said heavy oil.

11. A system for producing a water-in-oil emulsion fuel, comprising:

an additive solution tank for producing an emulsifying additive solution by mixing NAOH and $CaCl_2$ and water and storing the additive solution therein;

a water tank for producing mixed water by mixing said emulsifying additive solution from said additive solution tank with water in a weight ratio greater than 1:100 and storing said mixed water therein;

a mixing tank for mixing heavy oil and said mixed water from said water tank having said water and emulsifying additive solution so that said water substantially uniformly distributed and suspended in the dispersion medium of said heavy oil to produce said water-in-oil emulsion fuel; and a storage tank for storing said water-in-oil emulsion fuel therein to provides said emulsion fuel to a burning facility.

12. A system for producing a water-in-oil emulsion fuel as defined in claim 11, wherein said water substantially uniformly distributed and suspended in the dispersion medium of said heavy oil in such a manner that substantially each of the particles of said emulsion fuel has a core of said water encapsulated by said heavy oil.

13. A system for producing a water-in-oil emulsion fuel as defined in claim 11, wherein each of said water tank, mixing tank and storage tank is provided with heating means for heating liquid in each of said tanks.

14. A system for producing a water-in-oil emulsion fuel as defined in claim 11, wherein each of said additive solution tank, water tank, mixing tank and storage tank is provided with a level gauge to monitor a surface level of liquid in each of said tanks and send a signal to a control panel when said surface level reaches a predetermined value.

15. A system for producing a water-in-oil emulsion fuel as defined in claim 11, wherein said NAOH; $CaCl_2$ and water are mixed in a weight ratio ranging from about 10:10:100 to about 50:50:100.

16. A system for producing a water-in-oil emulsion fuel as defined in claim 11, wherein said NAOH; $CaCl_2$ and water are mixed in a weight ratio ranging from about 15:15:100 to about 35:35:100.

17. A system for producing a water-in-oil emulsion fuel as defined in claim 11, wherein said NAOH; $CaCl_2$ and water are mixed in a weight ratio of about 20:20:100.

18. A system for producing a water-in-oil emulsion fuel as defined in claim 11, wherein said heavy oil includes heavy oil type A, heavy oil type B and heavy oil type C.

19. A system for producing a water-in-oil emulsion fuel as defined in claim 11, wherein said water and said heavy oil are mixed in said mixing tank in a weight ratio from about 95:5 to about 30:70.

20. A system for producing a water-in-oil emulsion fuel as defined in claim 11, wherein said water and said heavy oil are mixed in said mixing tank in a weight ratio from about 70:30 to about 75:25.

21. A system for producing a water-in-oil emulsion fuel as defined in claim 11, wherein said water-in-oil emulsion fuel oil in said storage tank has a mixing ratio between a sum of said water and heavy oil and said emulsifying additive solution from about 1:0.01 to about 1:0.001 in a weight ratio.

22. A system for producing a water-in-oil emulsion fuel as defined in claim 11, wherein said water-in-oil emulsion fuel oil in said storage tank has a mixing ratio between a sum of said water and heavy oil and said emulsifying additive solution from about 1:0.003 to about 1:0.002 in a weight ratio.

23. A method of making a water-in-oil emulsion fuel, comprising the following steps of:

mixing NAOH; $CaCl_2$ and water to form an emulsifying additive solution in a weight ratio ranging from about 10:10:100 to about 50:50:100;

adding said emulsifying additive solution to a mixture of heavy oil and water wherein said mixture contains heavy oil and water in a weight ratio from about 95:5 to about 30:70; and mixing said emulsifying additive solution and said mixture of heavy oil and water wherein said mixture of heavy oil and water and said emulsifying additive are mixed in a weight ratio from about 1:0.01 to about 1:0.001.

24. A method of making a water-in-oil emulsion fuel as defined in claim 23, further comprising a step of heating the mixture of said heavy oil, said water and said emulsifying additive solution to maintain a low degree of viscosity of said mixture.

25. A method of making a water-in-oil emulsion fuel as defined in claim 23, further comprising a step of monitoring a surface level of said mixture of said heavy oil, said water and said emulsifying additive solution and generating a signal when said surface level decreased to a predetermined level.

26. A method of making a water-in-oil emulsion fuel, comprising the following steps of:

mixing NAOH; $CaCl_2$ and water to form an emulsifying additive solution in a weight ratio ranging from about 10:10:100 to about 50:50:100;

adding said emulsifying additive solution to water to form mixed water wherein said mixed water contains said additive solution and said water in a weight ratio greater than 1:100; and adding said mixed water to heavy oil and mixing said mixed water and said heavy oil to form said water-in-oil emulsion fuel wherein said water substantially uniformly distributed and suspended in the dispersion medium of said heavy oil in such a manner that substantially each of the particles of said emulsion fuel has a core made of said water encapsulated by said heavy oil.

* * * * *